US007225854B2

(12) United States Patent
Fukumoto et al.

(10) Patent No.: US 7,225,854 B2
(45) Date of Patent: Jun. 5, 2007

(54) CASTING METHOD AND CASTING APPARATUS

(75) Inventors: Yasuhiro Fukumoto, Fuchu-cho (JP); Kouji Furutani, Fuchu-cho (JP); Tomohiro Fujita, Fuchu-cho (JP); Kousuke Izumiuchi, Fuchu-cho (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 11/066,258

(22) Filed: Feb. 28, 2005

(65) Prior Publication Data

US 2005/0217821 A1 Oct. 6, 2005

(30) Foreign Application Priority Data

Mar. 30, 2004 (JP) ..... 2004-099506

(51) Int. Cl.
*B22D 17/32* (2006.01)

(52) U.S. Cl. ..... 164/113; 164/453

(58) Field of Classification Search ..... 164/113, 164/61, 62, 120, 453
See application file for complete search history.

(56) References Cited

U.S. PATENT DOCUMENTS 5,566,743 A * 10/1996 Guergov ..... 164/457
5,785,110 A * 7/1998 Guergov ..... 164/113
6,202,733 B1 * 3/2001 Ratte ..... 164/61
6,808,008 B2 * 10/2004 Kubota ..... 164/305

FOREIGN PATENT DOCUMENTS

JP 2002-103014 4/2002

* cited by examiner

*Primary Examiner*—Len Tran
(74) *Attorney, Agent, or Firm*—Nixon Peabody LLP; Donald R. Studebaker

(57) ABSTRACT

In a process of pouring molten metal under pressure into a die cavity C through a pouring gate G, a molten metal pressure in a part of the die cavity to be filled with the molten metal later than the rest thereof, or in the vicinity of the part, is detected by a first pressure sensor S5, and a cavity backpressure in the part of the die cavity to be filled with the molten metal later than the rest thereof, or in the vicinity of the part is detected by a backpressure sensor 12. Then, a pouring rate of the molten metal is controlled in accordance with changes in the respective detected pressures.

7 Claims, 4 Drawing Sheets

CASTING METHOD AND CASTING APPARATUS

BACKGROUND OF THE INVENTION

1. Field of the Invention

The present invention relates to a casting method based on a pressure casting process, and a casting apparatus for use in this casting method.

2. Description of the Related Art

As is generally known, a casting process of pouring molten metal or molten alloy (hereinafter referred to occasionally as "molten metal" for brevity) under pressure into a die cavity (hereinafter referred to occasionally as "cavity" for brevity), so-called pressure casting process, e.g. a die casting process, is often used, for example, in casting where light metal or light alloy, such as aluminum or its alloy, or magnesium or its alloy, are used as a material.

However, even the casting using the pressure casting process still involves a problem about defects occurring at a portion of molten metal located in a part of the die cavity relatively far from a pouring gate (for example, typically seen in the most downstream portion of molten metal relative to the pouring gate), such as: so-called "shrinkage cavity" occurring when the portion has a large thickness, so-called "misrun" occurring when the portion has a small thickness, etc. Generally, such defects are caused by the fact that a pressure of molten metal is not effectively transmitted to the portion located a certain distance or more from the pouring gate, or that air in the die cavity is trapped by or entrained into molten metal.

The insufficient transmission of a molten metal pressure in a portion located a certain distance or more from the pouring gate generally arises from deterioration of dies, fluctuation in surface temperature of dies due to changes in working temperature or cooling conditions (amount and/or temperature of cooling water, etc.) of the dies, fluctuation in temperature and/or chemical contents of the molten metal, and/or other factors. The entrainment of air into the molten metal generally arises from fluctuation in molten metal temperature, chemical contents of the molten metal or occluded gases, lowering in degree of evacuation due to deterioration of die-sealing materials, and/or other factors. It is also known that an excessive pouring rate of molten metal into the die cavity is liable to cause the entrainment of air.

While the occurrence of casting defects due to insufficient pressure (or insufficient filling) or air entrainment can be drastically reduced by exactly detecting and controlling the above various factors, the practical use of such measures has not been achieved because of a lot of costs required therefore.

In connection with the above problems about the pressure casting, for example, Japanese Patent Laid-Open Publication No. 2002-103014 proposes a metal injection molding method, which detects a molten metal pressure in a molten metal flow channel on its downstream side relative to a die cavity, and then sets a pouring rate (injection speed) of molten metal into the cavity in accordance with the change of pressure in the molten metal flow channel.

In order to prevent the occurrence of casting defects due to insufficient filling, it is most desirable that the filling of molten metal is completed before the molten metal finishes solidifying, i.e. when the molten metal is still in its fully molten state (i.e. liquid phase) or at least in its semi-molten state (i.e. mixed phase of liquid and solid), to assure the good states of "run" (i.e. to prevent the occurrence of misrun) and to allow the pressure of the molten metal to be transmitted to every distal end of a cast article. Therefore, it is required to fill a die cavity with molten metal at a high pouring rate to a maximum extent. On the other hand, in order to prevent the occurrence of casting defects due to air entrainment, it is also required to keep the pouring rate of the molten metal into the die cavity from excessively high level.

That is, an excellent cast article free from casting defects due to insufficient filling or air entrainment can be obtained, only if a condition for filling a die cavity with molten metal is set in such a manner that the above two conflicting factors are simultaneously satisfied.

However, the aforementioned prior art designed to set the injection speed in accordance with only the detected molten metal pressure can facilitate to suppress the occurrence of defects due to insufficient filling, but has difficulties in stably preventing the occurrence of defects due to air entrainment.

Accordingly, as a solution of the above problems, a casting method and a casting apparatus which simultaneously suppress both the occurrence of defects due to insufficient filling of molten metal and the occurrence of defects due to air entrainment has been desired.

SUMMARY OF THE INVENTION

It is an object of the present invention to provide a casting method and a casting apparatus which are free from the problems residing in the prior art.

According to an aspect of the present invention, a casting method pouring molten metal under pressure into a die cavity through a pouring passage comprises reducing an internal pressure of the die cavity through an evacuation passage; detecting a molten metal pressure in at least one of a plurality of parts of the die cavity to be filled with the molten metal later than the rest thereof and of vicinities of the parts, during pouring of the molten metal; detecting a cavity backpressure in at least one of the plurality of parts of the die cavity to be filled with the molten metal later than the rest thereof and of the vicinities of the parts; and controlling a pouring rate of the molten metal in accordance with changes in the respective detected pressures.

This casting method can effectively detect the states of run and air entrainment in the plurality of parts of the die cavity to be filled with the molten metal later than the rest thereof and of the vicinities of the parts, to control the pouring rate of the molten metal in accordance with the detection result. This makes it possible to suppress the occurrence of defects due to air entrainment as well as the occurrence of defects due to insufficient filling of molten metal.

These and other objects, features and advantages of the present invention will become more apparent upon the following detailed description along with the accompanying drawing.

DETAILED DESCRIPTION OF PREFERRED EMBODIMENTS OF THE INVENTION

A preferred embodiment for achieving the features of the present invention and its effects will now be described with reference to the accompanying drawings.

Figure 1:
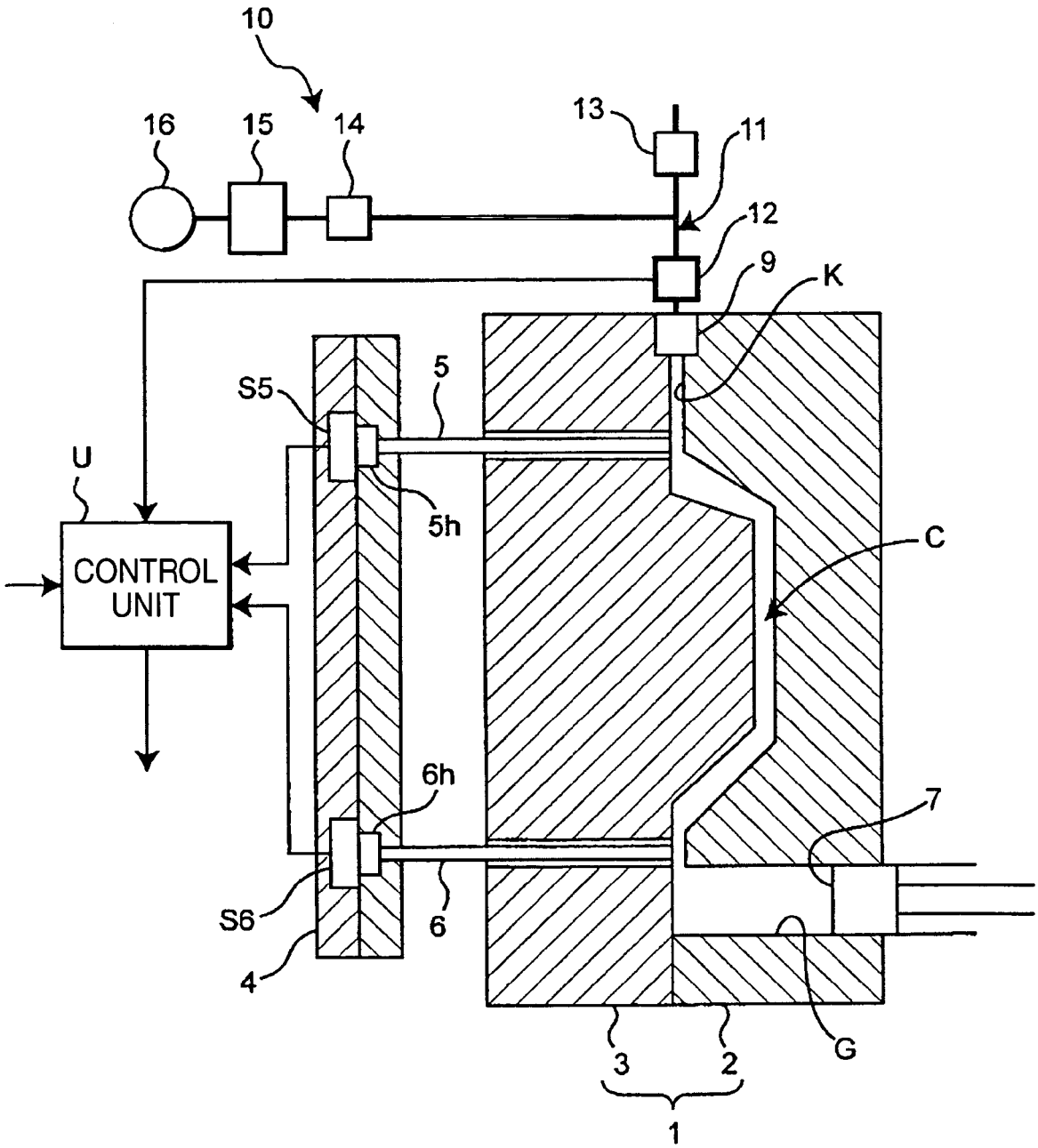
FIG. 1 is an explanatory diagram schematically showing the overall structure of a casting apparatus according to one embodiment of the present invention.

FIG. 1 is an explanatory diagram schematically showing the overall structure of a casting apparatus according to the embodiment. As shown in FIG. 1, the casting apparatus comprises: a die assembly 1, including a fixed die 2 and a movable die 3 designed to be moved to come in contact with and get away from the fixed die 2; an ejector drive plate 4 for driving ejector pins 5, 6 each attached to the movable die 3; and a plunger 7 for pressurizing molten metal to allow a die cavity C defined by surface of the fixed die 2 and the movable die 3 to be filled with the molten metal.

For example, the above casting machine may be a high pouring rate die-casting machine, and the molten metal for use in casting may be a molten light metal or a molten light-alloy, such as aluminum or its alloy, or magnesium or its alloy. More specifically, ADC 10 or ADC 12 defined as Japanese Industrial Standard (JIS) H5302 is suitable as a material applicable to the aluminum alloy, and MDC2B or MDC3B defined as Japanese Industrial Standard (JIS) H53032 is suitable as a material applicable to the magnesium alloy.

While the casting machine in the embodiment illustrated in FIG. 1 is designed such that the fixed die 2 is provided with the plunger 7 and that the movable die 3 is provided with the ejector pins 5, 6 respectively, the present invention is not limited to this arrangement, but that the movable die 3 is provided with the plunger 7 and that the fixed die 2 may be provided with the ejector pins 5, 6 respectively. Further, the casting machine may be a vertical type in which the fixed die 2 and the movable die 3 are disposed vertically.

In the state that the die assembly 1 is clamped, molten metal (i.e. metal in its molten state) is pressed by the plunger 7 so that it is poured under pressure from a pouring gate G into the die cavity C. A driving speed of the plunger 7 can be controllably adjusted to control an injection speed (i.e. pouring rate) of the molten metal into the cavity C. After holding the pressure of the molten metal, the molten metal in the cavity C is sufficiently solidified and cooled. Then, the movable die 3 is driven to open the die assembly 1, and the ejector pins 5, 6 are moved to protrude on the side of the cavity C so as to allow a cast article (not shown) to be ejected. In this manner, one casting cycle is completed.

The ejector pin 6 is located on the upstream side of a molten metal flow channel in the cavity C (in FIG. 1, the pouring gate side of the cavity C), and the ejector pin 5 is located on the downstream side of the molten metal flow channel (in FIG. 1, in the vicinity of a distal end of the cavity C farthest away from the pouring gate G).

In this embodiment, two pressure sensors S5, S6 in contact with corresponding ones of heads 5*h*, 6*h* of the ejector pins 5, 6 are provided in the ejector drive plate 4. These pressure sensors S5, S6 are operable to detect molten metal pressures in the cavity C through the ejector pins 5, 6. These molten metal pressures detected by the pressure sensors S5, S6 are input into a control unit U of the casting system as pressure detection signals. More preferably, the control unit U comprises a major component consisting of a microcomputer, which is designed to allow control signals for the casting apparatus to be input thereinto, and output injection-speed control signals and injection-pressure control signals to a drive unit (not shown) for the plunger 7.

An evacuation passage K is provided in the distal end of the die cavity C to reduce a pressure in the cavity C (i.e. internal pressure of the die cavity) from the distal end, and a shutoff valve 9 is provided on the outlet side of the evacuation passage K to controllably open and close the passage K. A vacuum piping system 11 of an evacuation mechanism 10 is connected to the shutoff valve 9. The vacuum piping system 11 is provided with a backpressure sensor 12, an open-to-atmosphere valve 13, which are arranged in this order from the upstream side thereof, and with an evacuation control valve 14, a vacuum tank 15, and a vacuum pump 16, which are also arranged in this order from the upstream side thereof.

The backpressure sensor 12 is operable to detect internal pressure of the die cavity, and obtained detection signals are input to the control unit U as backpressure signals. As used in this specification, the term "backpressure (or cavity backpressure)" means a pressure in the distal end of the cavity C to be detected by the sensor 12. The cavity backpressure is a pressure generated by an atmosphere gas (typically, air) remaining in the cavity and a gas released from the molten metal. The open-to-atmosphere valve 13 is normally closed, and operable, when it is opened, to allow a reduced pressure in the vacuum piping system to be introduced to the atmosphere.

The vacuum pump 16 is operable to evacuate gas from the vacuum piping system 11 so as to reduce a pressure therein. The vacuum pump 16 is kept in its operating state, and a vacuum (negative pressure) generated by the vacuum pump 16 is accumulated in the vacuum tank 15 having a given volume.

The evacuation control valve 14 is operable, when it is opened, to introduce a negative pressure to a region on the upstream side of the vacuum piping system 11, and depressurize (or evacuate) the region. Thus, a degree of this evacuation (i.e. the difference between an internal pressure of the die cavity and an ambient pressure) can be controlled according to the setting of the evacuation control valve 14.

A casting process based on the above casting apparatus will be described below.

Figure 2:
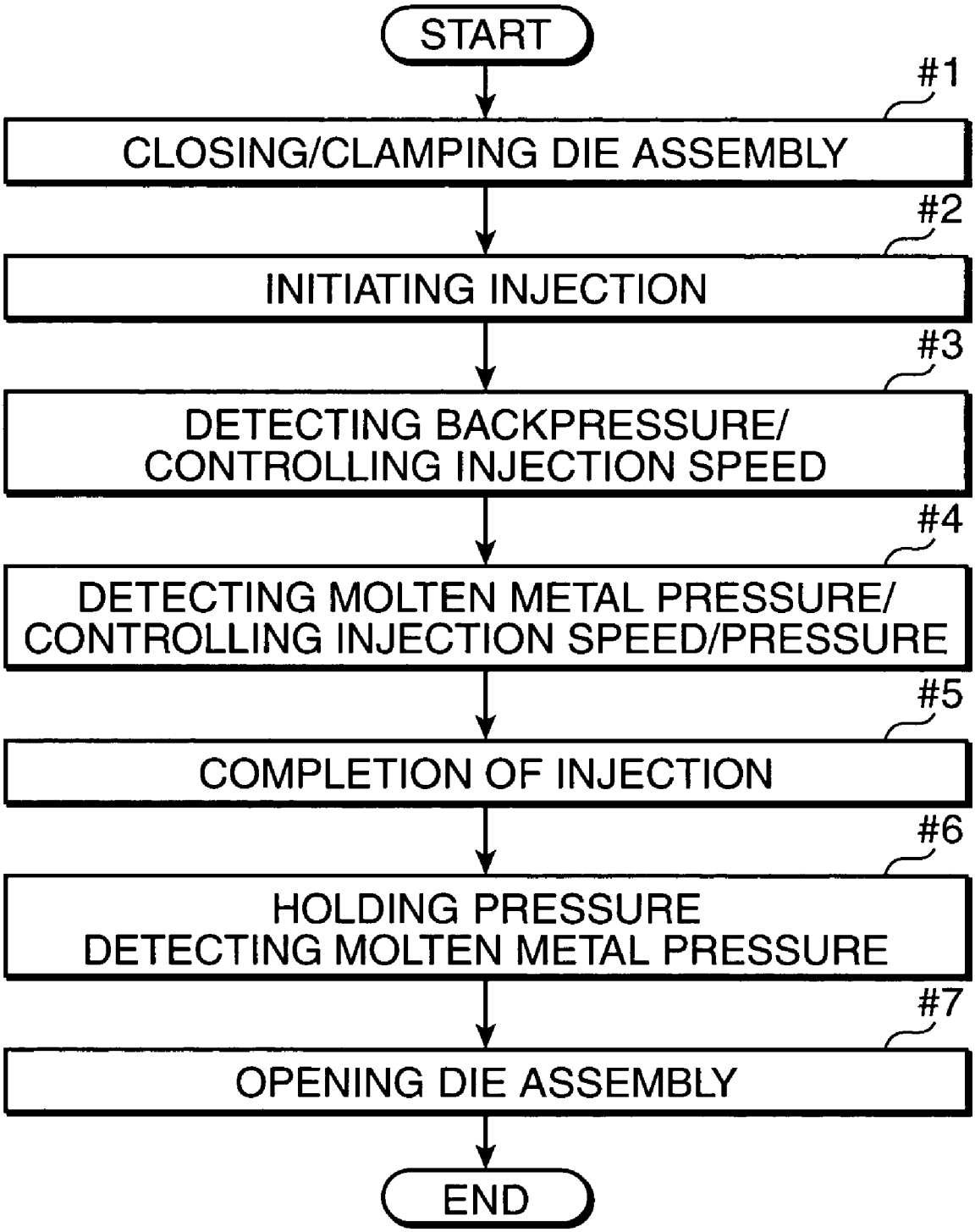
FIG. 2 is an explanatory flow chart showing steps in one cycle of a casting process to be performed using the casting apparatus.
Figure 3:
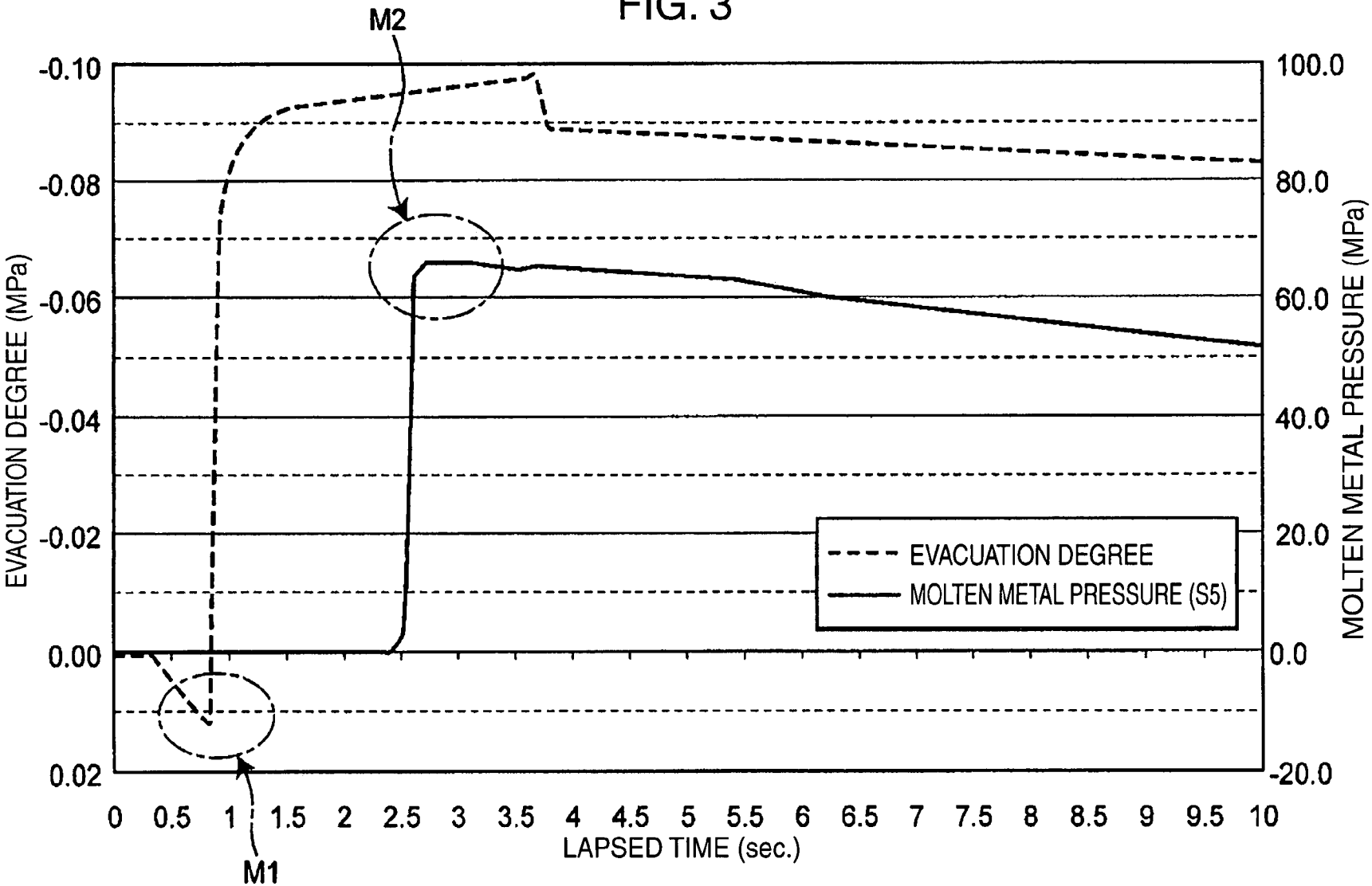
FIG. 3 is an explanatory time chart of steps up to a pressure-holding step in one cycle of the casting process.
Figure 4:
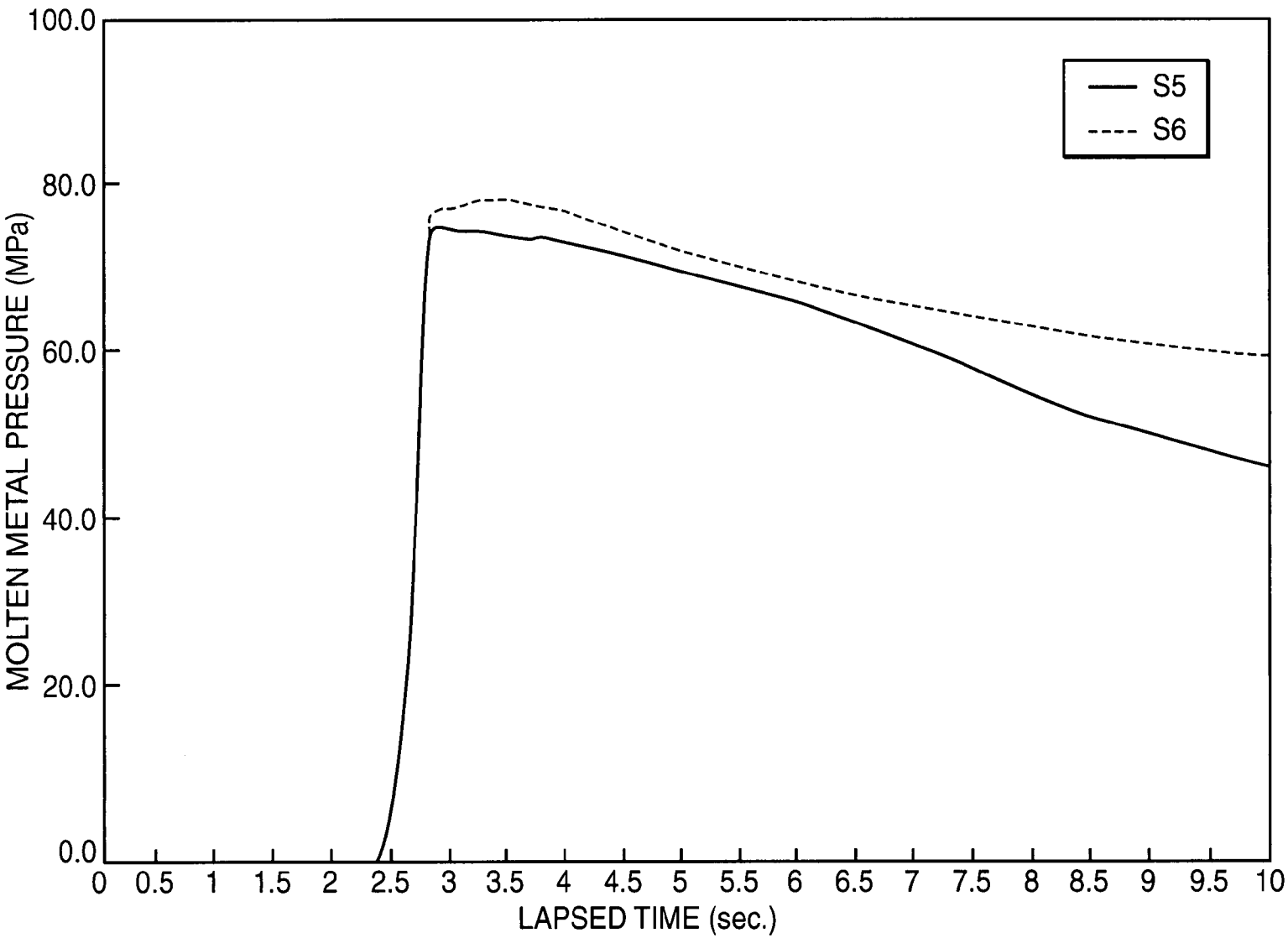
FIG. 4 is an explanatory time chart of a molten metal pressure during the steps up to the pressure-holding step in one cycle of the casting process.

FIG. 2 is an explanatory flow chart showing steps in one cycle of a casting process to be performed using the casting apparatus. FIG. 3 is an explanatory time chart of an evacuation degree in the distal end of the die cavity C during steps up to a pressure-holding step in one cycle of the casting process, wherein ADC 10 under JIS is used as molten metal. FIG. 4 is an explanatory time chart of a molten metal pressure during the steps.

As shown in FIGS. 2 to 4, in this casting process, the die assembly 1 is firstly closed and then clamped, at Step #1. Then, at Step #2, the injection of material (i.e. molten metal) into the die cavity C is initiated. At approximately the same time as or immediately after the initiation of the injection, an injection speed is controlled in accordance with a backpressure detection value detected by the backpressure sensor 12. Specifically, a driving speed of the plunger 7 is controlled in accordance with the detection value of the backpressure sensor 12.

This injection-speed control step at Step #3 is initiated from a zone Ml in the time chart of FIG. 3. As shown in this time chart, when the clamping of the die assembly is completed at Step #1, a pressure in the die cavity C (i.e. internal pressure of the die cavity) has a positive value. In conjunction with the clamping of the die assembly or immediately after completion of the clamping of the die assembly, the evacuation valve 14 is opened so that the pressure in the die cavity C starts being reduced through the evacuation passage K. The injection speed is controlled according to a degree of this evacuation.

In this embodiment, when a detection value of the backpressure sensor 12 is greater than a predetermined value, the amount of air in the die cavity C is greater than a predetermined amount. Thus, in view of suppressing the occurrence of defects due to air entrainment, the plunger 7 is controlled to provide a reduced injection speed. On the other hand, when a detection value of the backpressure sensor 12 is less than the predetermined value, the amount of air in the die cavity C is less than the predetermined amount, and thereby the risk of the occurrence of defects due to air entrainment is relatively low even if the injection speed of molten metal is increased. Thus, in this case, in view of intending to complete the filling of molten metal before the molten metal finishes solidifying (or when the molten metal is in its molten or semi-molten state), the plunger 7 is controlled to provide an increased injection speed.

Then, a slight before completion of the injection, the die cavity C is approximately filled with the molten metal in every part thereof, and each of the ejector pins 5, 6 receives a pressure from the injected molten metal. These molten metal pressures are transmitted through the ejector pins 5, 6, and detected by the pressure sensors S5, S6 which are in contact with and pressed by the heads 5*h*, 6*h* of the ejector pins 5, 6.

In particular, the ejector pin 5 is located in the vicinity of a part of the cavity C which is farthest away from the pouring gate G and the worst part of the molten metal run condition. That is, the ejector pin 5 is located in the vicinity of a part of the cavity C to be filled with the molten metal at the latest time as compared with the rest of the cavity C. Thus, based on a detected pressure in the pressure sensor S5 (first pressure sensor) corresponding to the ejector pin 5, it can be determined whether the entire die cavity C is adequately filled with the molten metal.

When the molten metal flows up to the vicinity of the distal end of the cavity C—the distal end in this embodiment is also a part to be filled with the molten metal at the latest time, the shutoff valve 9 is closed. This reliably prevents the backpressure sensor 12 located on the downstream side of the shutoff valve 9 from being damaged due to exposure to the high-temperature molten metal. At the same time, the evacuation control valve 14 is closed to stop the evacuation action of the evacuation mechanism.

The above control at Step #3 is completed just before a zone M2 in the time chart of FIG. 3.

Then, more preferably, at Step #4, which is approximately just before completion of the injection, the injection speed and injection pressure are controlled in accordance with detection values of the pressure sensors S5 and S6. Specifically, the driving speed and pressing force of the plunger 7 is controlled in accordance with detection values of the pressure sensors S5 and S6.

Fundamentally, this control is performed in accordance with a detection value of the first pressure sensor S5 for detecting a molten metal pressure in the part having the worst filling condition. That is, when a detection value of the first pressure sensor S5 is greater than a predetermined value, a molten metal pressure is too high as compared with a predetermined pressure, and thereby an excessive pressure acts on components of the die assembly 1, which is likely to cause short life span or damages in the components. Thus, in this case, the plunger 7 is fundamentally controlled to provide a reduced injection pressure (or, additionally a reduced injection speed). On the other hand, when a detection value of the first pressure sensor S5 is less than the predetermined value, a molten metal pressure is lower than the predetermined pressure, which is likely to cause insufficient filling. Thus, in this case, the plunger 7 is fundamentally controlled to provide an increased injection pressure (or, additionally an increased injection speed).

The molten metal pressure is rapidly increased until the die cavity is filled with the molten metal, and peaked approximately at the time of completion of the filling. Then, the molten metal pressure is slowly reduced. Thus, in this embodiment, more preferably, based on the comparison between respective detection values of the first pressure sensor S5 for detecting a molten metal pressure in the part of the cavity C to be filled with the molten metal at the latest time, and the second pressure sensor S6 for detecting a molten metal pressure on the pouring gate side of the cavity C, the injection speed and injection pressure are controlled such that the respective detection values have approximately the same maximum value, and reach the maximum value at approximately the same time, as shown in FIG. 4.

This control allows molten metal pressures in respective parts of the die cavity C to be further equalized when the detected molten metal pressure reaches a maximum value, so as to further effectively suppress the occurrence of casting defects and prevent an excessive load from being imposed on the die assembly.

The above control at Step #4 is performed in the zone M2 in the time chart of FIG. 3.

Then, the injection is completed at Step #5. In conjunction with the completion of the injection, a pressure-holding step (Step #6) is initiated. In this pressure-holding step, the detection of the molten metal pressure by the first and second pressure sensors 5, 6 is performed following Step #4. This detection data is transmitted to the control unit U, and then fed back as correction data for the pressure control in the next shot (cycle). Data just after completion of the injection is particularly effective for correcting the control at Step #4. More preferably, not only detection data during the pressure-holding step at Step #6 in each shot but also detection data during the control step at Step #4 are transmitted to the control unit U, and then fed back as correction data for controls in the next shot. The above detection data is readably stored on a storage section in the control unit U or a memory device associated with the control unit U.

After holding the pressure, the molten metal in the cavity C is sufficiently solidified and cooled. Then, the movable die 3 is driven to open the die assembly 1 (Step #7), and the ejector pins 5, 6 are moved to protrude on the side of the cavity C so as to allow a cast article (not shown) to be ejected. In this manner, one casting cycle is completed.

As described above, according to this embodiment, a molten metal pressure in the vicinity of the distal end of the die cavity C and a backpressure of the cavity C are detected, respectively, by the first pressure sensor S5 and the backpressure sensor 12, so that the states of run and residual air in the vicinity of the part which is farthest away from the pouring gate G and the worst part of the molten metal run condition can be detected. The pouring rate of the molten metal is then controlled in accordance with the detection result, so that both of insufficient filling of molten metal and air entrainment can be simultaneously suppressed. In particular, the control providing an increased injection speed allows the filling of molten metal to be completed before the molten metal finishes solidifying, so as to eliminate the risk of the occurrence of casting defects due to air entrainment.

Further, the molten metal pressure is detected on the pouring gate side of the die cavity C by the second pressure sensor S6, in addition to the detection in the distal end of the die cavity C, or is detected on the downstream and upstream sides in the flow direction of the molten metal. Thus, the state of pressure of the entire molten metal in the die cavity C can be detected with a higher degree of accuracy to further effectively suppress the occurrence of casting defects. In particular, a pouring rate of the molten metal is controlled such that respective molten metal pressures in both the distal and proximal ends relative to the pouring gate (i.e. in the parts both of the distal end and on the pouring gate side) have approximately the same maximum value, and reach the maximum value at approximately the same time. This control allows molten metal pressures in respective parts of the die cavity to be further equalized when the detected molten metal pressure reaches a maximum value, so as to further effectively suppress the occurrence of casting defects.

Furthermore, control contents for the molten metal up to a previous shot are stored, and a control condition for a next shot is set in accordance with the stored control contents, so that the control can be performed to cope, particularly, with changes over time in a die assembly and a molten metal pouring device. Thus, even if molten metal is continuously injected at a high speed, the occurrence of casting defects in each shot can be suppressed.

In addition, the die cavity C is evacuated from the distal end thereof. Thus, the air entrainment in the distal end can be further effectively suppressed. The backpressure sensor 12 designed to detect a pressure in the evacuation passage K can detect the cavity backpressure further readily and reliably.

As described above, an inventive casting method for pouring molten metal under pressure into a die cavity through a pouring passage comprises: an evacuation step of reducing an internal pressure of the die cavity through an evacuation passage; a molten metal pressure detection step of detecting a molten metal pressure in at least one of a plurality of parts of the die cavity to be filled with the molten metal later than the rest thereof and of vicinities of the parts, during pouring of the molten metal; a backpressure detection step of detecting a cavity backpressure in at least one of the plurality of parts of the die cavity to be filled with the molten metal later than the rest thereof and of the vicinities of the parts; and a control step of controlling a pouring rate of the molten metal in accordance with changes in pressures detected at the respective detection steps.

According to the above casting method, the states of run and air entrainment in the plurality of parts of the die cavity to be filled with the molten metal later than the rest thereof, and of the vicinities of the parts, can be detected to control the pouring rate of the molten metal in accordance with the detection result. This makes it possible to suppress the occurrence of defects due to air entrainment as well as the occurrence of defects due to insufficient filling of molten metal. In particular, when a cast article has a complicated shape, the cavity has a number of parts to be filled with the molten metal later than the rest thereof. In this case, among the plurality of parts of the die cavity to be filled with the molten metal later than the rest thereof, a specific part requiring to suppress casting defects in an intended cast article may be subjected to the detection of the molten metal pressure and the cavity backpressure. Further, the technique of completing the filling of molten metal before the molten metal finishes solidifying, which serves as a countermeasure for effectively suppressing the occurrence of defects due to insufficient filling of molten metal, can be effectively used without the occurrence of casting defects due to air entrainment.

In the casting method, it is preferable that each of the parts of the die cavity to be filled with the molten metal later than the rest thereof is located in a distal end of the die cavity. In this case, the same effects as those in the casting method can be obtained. Additionally, a poor run or misrun at the edges of a cast article corresponding to the distal ends of the cavity can be prevented.

In the casting method, it is preferable that each of the parts of the die cavity to be filled with the molten metal later than the rest thereof is a part to be filled with the molten metal at a latest time. In this case, the same effects as those in the casting method can be obtained. Additionally, the entire cavity can be filled with the molten metal to obtain a cast article free of the occurrence of a short shot and/or a flash.

Preferably, the above casting method further comprises a second molten metal pressure detection step of detecting a molten metal pressure on the pouring passage side of the die cavity, wherein the control step includes controlling the pouring rate of the molten metal in such a manner that both the molten metal pressure in the part of the die cavity to be filled with the molten metal later than the rest thereof and the molten metal pressure on the pouring passage side have approximately a same maximum value, and reach the maximum value at approximately a same time.

In this case, the same effects as those in the casting method can be obtained. Further, in addition to the molten metal pressure in the part of the die cavity to be filled with the molten metal later than the rest thereof, the molten metal pressure on the pouring gate side of the die cavity can also be detected so that the state of molten metal pressures in the die cavity can be detected with a higher degree of accuracy to further effectively suppress the occurrence of casting defects. In particular, an pouring rate of the molten metal can be controlled such that the molten metal pressure in the part of the die cavity to be filled with the molten metal later than the rest thereof and the molten metal pressure on the pouring gate side of the die cavity have approximately the same maximum value, and reach the maximum value at approximately the same time, so that molten metal pressures in respective parts of the die cavity can be further equalized when the detected molten metal pressure reaches a maximum value to further effectively suppress the occurrence of casting defects.

Further, it is preferable that the above casting method further comprises a control-content storage step of storing control contents for the molten metal up to a previous shot, wherein the control step includes setting a control condition for a next shot in accordance with the stored control contents.

In this case, the control condition for a next shot can be set in accordance with the control contents for the molten metal up to a previous shot, in such a manner as to cope, particularly, with changes over time in a die assembly and a molten metal pouring device.

More preferably, in the above casting method, the evacuation passage is connected to the part of the die cavity to be filled with the molten metal later than the rest thereof or connected to the vicinity of the part, in which the molten metal pressure is detected, wherein the backpressure detection step includes detecting a pressure in the evacuation passage.

This makes it possible to evacuate the die cavity, particularly, from the part of the die cavity to be filled with the molten metal later than the rest thereof, or from the vicinity of the part, so as to further effectively suppress the occurrence of casting defects in a part where the air entrainment is most likely to occur. In addition, the detection of the pressure in the evacuation passage allows the cavity backpressure to be detected further readily and reliably.

In the above casting method, it is more preferable that the filling of the molten metal into the die cavity is completed when the molten metal is in its molten or semi-molten state.

Particularly, this makes it possible to further effectively suppress the occurrence of casting defects due to insufficient filling.

An inventive casting apparatus, as also mentioned above, for pouring molten metal under pressure into a die cavity through a pouring passage comprises: an evacuation unit for reducing an internal pressure of the die cavity through an evacuation passage; a molten metal pressure detection unit for detecting a molten metal pressure in at least one of a plurality of parts of the die cavity to be filled with the molten metal later than the rest thereof and of vicinities of the parts, during pouring of the molten metal; a backpressure detection unit for detecting a cavity backpressure in at least one of the plurality of parts of the die cavity to be filled with the molten metal later than the rest thereof and of the vicinities of the parts; and a control unit for controlling a pouring rate of the molten metal in accordance with changes in pressures detected by the respective detection units.

According to the above casting apparatus, the states of run and air entrainment in the plurality of parts of the die cavity to be filled with the molten metal later than the rest thereof, and of the vicinities of the parts, can be detected to control the pouring rate of the molten metal in accordance with the detection result. This makes it possible to suppress the occurrence of defects due to air entrainment as well as the occurrence of defects due to insufficient filling of molten metal. In particular, the technique of completing the filling of molten metal before the molten metal finishes solidifying, which serves as a countermeasure for effectively suppressing the occurrence of defects due to insufficient filling of molten metal, can be effectively used without the occurrence of casting defects due to air entrainment.

In the above casting apparatus, it is preferable that each of the parts of the die cavity to be filled with the molten metal later than the rest thereof is located in a distal end of the die cavity. This can prevent the lack of material at the edges of a cast article corresponding to the distal end of the cavity.

In the above casting apparatus, it is preferable that each of the parts of the die cavity to be filled with the molten metal later than the rest thereof is a part to be filled with the molten metal at a latest time. This allows the entire cavity to be filled with the molten metal so as to obtain a cast article free of the occurrence of a short shot and/or a flash.

Preferably, the above casting apparatus further comprises a second molten metal pressure detection unit for detecting a molten metal pressure on the pouring passage side of the die cavity, wherein the control unit is operable to control the pouring rate of the molten metal in such a manner that both the molten metal pressure in the part of the die cavity to be filled with the molten metal later than the rest thereof and the molten metal pressure on the pouring passage side have approximately a same maximum value, and reach the maximum value at approximately a same time.

In this case, in addition to the molten metal pressure in the part of the die cavity to be filled with the molten metal later than the rest thereof, the molten metal pressure on the pouring gate side of the die cavity can also be detected so that the state of molten metal pressures in the die cavity can be detected with a higher degree of accuracy to further effectively suppress the occurrence of casting defects. In particular, an pouring rate of the molten metal can be controlled such that the molten metal pressure in the part of the die cavity to be filled with the molten metal later than the rest thereof and the molten metal pressure on the pouring gate side of the die cavity have approximately the same maximum value, and reach the maximum value at approximately the same time, so that molten metal pressures in respective parts of the die cavity can be further equalized when the detected molten metal pressure reaches a maximum value to further effectively suppress the occurrence of casting defects and prevent an excessive load from being imposed on the die assembly.

Further, it is preferable that the above casting apparatus further comprises a storage unit for storing control contents up to a previous shot, wherein the control unit is operable to set a control condition for a next shot in accordance with the stored control contents.

In this case, the control condition for a next shot can be set in accordance with the control contents for the molten metal up to a previous shot, in such a manner as to cope, particularly, with changes over time in a die assembly and a molten metal pouring device.

More preferably, in the above casting, the evacuation passage is connected to the part of the die cavity having a lower filling rate of the molten metal than that in the rest thereof or connected to the vicinity of the part, wherein the backpressure detection unit is operable to detect a pressure in the evacuation passage.

This makes it possible to evacuate the die cavity, particularly, from the part of the die cavity to be filled with the molten metal later than the rest thereof, or from the vicinity of the part, so as to further effectively suppress the occurrence of casting defects in an part where the air entrainment is most likely to occur. In addition, the detection of the pressure in the evacuation passage allows the cavity backpressure to be detected further readily and reliably.

As described above, the above method and apparatus have the significant effect of allowing the suppression of both the occurrence of defects due to insufficient filling of molten metal and the occurrence of defects due to air entrainment to be simultaneously achieved.

This application is based on Japanese Patent Application No. 2004-099506 filed on Mar. 30, 2004, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A casting method for pouring molten metal under pressure into a die cavity through a pouring passage, comprising:

an evacuation step of reducing an internal pressure of said die cavity through an evacuation passage;

a molten metal pressure detection step of detecting a molten metal pressure in at least one of a plurality of parts of said die cavity to be filled with the molten metal later than the other part of said die cavity and of vicinities of said parts, during pouring of the molten metal;

a backpressure detection step of detecting a cavity backpressure of air and gas in at least one of said plurality of parts of the die cavity to be filled with the molten metal later than the other part of said die cavity and of the vicinities of said parts; and a control step of controlling a pouring rate of the molten metal in accordance with changes in pressures detected at said respective detection steps.

2. The casting method as defined in claim 1, wherein each of said parts of the die cavity to be filled with the molten metal later than the other part of said die cavity is located in a distal end of said die cavity.

3. The casting method as defined in claim 1, wherein each of said parts of the die cavity to be filled with the molten metal later than the other part of said die cavity is a part to be filled with the molten metal at a latest time.

4. The casting method as defined in claim 2, which further comprises a second molten metal pressure detection step of detecting a molten metal pressure on said pouring passage side of said die cavity, wherein said control step includes controlling the pouring rate of the molten metal in such a manner that both the molten metal pressure in said part of the die cavity to be filled with the molten metal later than the other part of said die cavity and the molten metal pressure on said pouring passage side have approximately a same maximum value, and reach said maximum value at approximately a same time.

5. The casting method as defined in claim 2, which further comprises a control-content storage step of storing control contents for the molten metal up to a previous shot, wherein said control step includes setting a control condition for a next shot in accordance with said stored control contents.

6. The casting method as defined in claim 2, wherein said evacuation passage is connected to said part of the die cavity to be filled with the molten metal later than the other part of said die cavity or connected to the vicinity of said part, in which said molten metal pressure is detected, wherein said backpressure detection step includes detecting a pressure of air and gas in said evacuation passage.

7. The casting method as defined in claim 2, wherein the filling of the molten metal into said die cavity is completed when said molten metal is in its molten or semi-molten state.

* * * * *